US006910691B2

(12) United States Patent
Shih

(10) Patent No.: US 6,910,691 B2
(45) Date of Patent: Jun. 28, 2005

(54) CUBIC PUZZLE

(76) Inventor: Sywan-Min Shih, 668, Wild Rose La., San Dimas, CA (US) 91773

( * ) Notice: Subject to any disclaimer, the term of this patent is extended or adjusted under 35 U.S.C. 154(b) by 0 days.

(21) Appl. No.: 10/377,730

(22) Filed: Mar. 4, 2003

(65) Prior Publication Data

US 2005/0110212 A1 May 26, 2005

(51) Int. Cl.[7] ..... A63F 9/12
(52) U.S. Cl. ..... 273/157 R; 273/160
(58) Field of Search ..... 273/157 R, 156, 273/160; D21/479

(56) References Cited

U.S. PATENT DOCUMENTS

| | | | | | |
|---|---|---|---|---|---|
| 3,638,949 | A | * | 2/1972 | Thompson | 273/157 R |
| 3,672,681 | A | * | 6/1972 | Wolf | 273/157 R |
| 4,153,254 | A | * | 5/1979 | Marc | 273/160 |
| 4,662,638 | A | * | 5/1987 | Vachek | 273/160 |
| 4,699,602 | A | * | 10/1987 | Giorgi | 273/157 R |

FOREIGN PATENT DOCUMENTS

| | | | | |
|---|---|---|---|---|
| EP | 249188 | * | 9/1987 | 273/157 R |
| EP | 349973 | * | 1/1990 | 273/157 R |
| FR | 2575663 | * | 7/1986 | 273/157 R |
| FR | 2608065 | * | 6/1988 | 273/157 R |
| GB | 2240281 | * | 7/1991 | 273/157 R |

* cited by examiner

*Primary Examiner*—Steven Wong
(74) *Attorney, Agent, or Firm*—Varndell & Varndell, PLLC

(57) ABSTRACT

A cubic puzzle includes eight identical elementary pieces. Each elementary piece is composed of eight identical blocks. The lower layer has a first, a second, and a third block linearly connected to a side face of each other and a fourth block transversely and securely connected to a side of the third block. The upper layer has a fifth block securely connected to a side of a sixth block, wherein the fifth block is formed on top of the first block, and a seventh block securely connected to a side of an eighth block, wherein the seventh block is formed on top of the fourth block. A position relationship between the sixth block and the fifth block and the seventh block to the eighth block corresponds to a position relationship between the fourth block and the third block.

7 Claims, 9 Drawing Sheets

CUBIC PUZZLE

BACKGROUND OF THE INVENTION

1. Field of the Invention

The present invention relates to a cubic puzzle, and more particularly to a cubic puzzle having eight elementary pieces with the same size and configuration. Each elementary piece is composed of eight blocks securely combined with one another. After rotation and reconfiguration among pieces, designated patterns on designated blocks are able to be gathered together so as to form a picture.

2. Description of Related Art

Puzzles include multiple pieces each with a designated pattern so that when a user regroups the pieces, a picture or a particular image is presented, which provides practice to the coordination of the user's concept to space and structural relationship between pieces. However, no matter how large the quantity of the pieces is, puzzles only provide user's spatial concept in two dimensions. To enhance spatial concept and increase entertainment to the user, building blocks are promoted so that users are able to train spatial concept via building and rebuilding. LEGO® is one building blocks trade name known all over the world. With the special design of each piece, users are able to explore their potential imagination, which is very interesting and educational to the users. However, playing with LEGO® requires quite a lot of space even though the pieces of LEGO® are portable. In order to overcome the shortcoming, a new toy called "magic cube" or "Rubik's Cube" is introduced to the market. The six faces of the magic cube respectively have a unique color different from the others. After rotation to different rows (or columns), the colors are mixed with one another. Therefore, players are able to use proper rotation to rows (or columns) to regroup the same colors together. The magic cube is portable and requires only a little space to play with. Actually, users can play with the magic cube within the palms. Therefore, magic cube does provide training to user's spatial concept as well as entertainment.

Nevertheless, rotation only makes the magic cube seem a little dull after a short while. Elements of the magic cube are always assembled in the same way and sometimes the user is not satisfied with the lack of versatility of the magic cube.

To overcome the shortcomings, the present invention tends to provide a cubic puzzle to mitigate and obviate the aforementioned problems.

SUMMARY OF THE INVENTION

The primary objective of the present invention is to provide an improved cubic puzzle which combines the fun of conventional puzzles with the entertainment of building blocks.

Another objective of the present invention is to provide an improved cubic puzzle which is able to be disassembled and reassembled after rotation so that designated patterns on elementary pieces are able to be matched with other identical patterns to form pictures.

Other objects, advantages and novel features of the invention will become more apparent from the following detailed description when taken in conjunction with the accompanying drawings.

DETAILED DESCRIPTION OF THE PREFERRED EMBODIMENT

Figure 1:
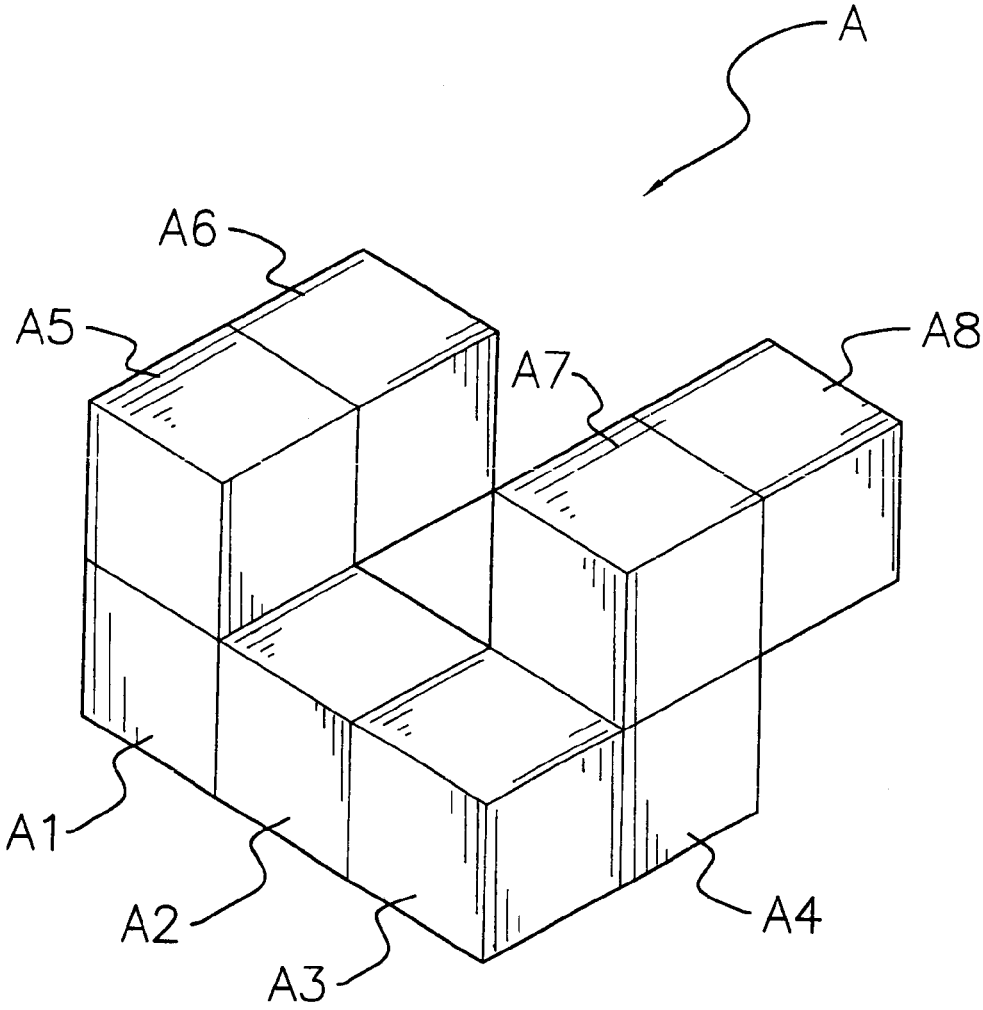
FIG. 1 is a perspective view of an elementary piece of the cubic puzzle of the present invention.

With reference to FIG. 1, an elementary piece (A) of the cubic puzzle in accordance with the present invention is composed of eight cubical blocks (A1–A8). The eight blocks (A1–A8) are distributed in a bottom layer and a top layer, wherein each layer has four blocks. From the direction in the drawing, the first block (A1), the second block (A2) and the third block (A3) are sequentially assembled in series with one face of each of the first, second and third blocks (A1,A2,A3) securely connected to an adjacent block. The fourth block (A4) is transversely connected to a side of the third block (A3). The fifth block (A5) is securely connected to a side of the sixth block (A6) and the fifth block (A5) is formed on top of the first block (A1). The seventh block (A7) is securely connected to a side of the eighth block (A8) and the seventh block (A7) is formed on top of the fourth block (A4). A position relationship between the sixth block (A6) and the fifth block (A5) and the seventh block (A7) to the eighth block (A8) corresponds to a position relationship between the fourth block (A4) and the third block (A3). When the foregoing structural relationship is confirmed, the elementary piece (A) is constructed.

In order to facilitate understanding of the cubic puzzle of the present invention, the first to the fourth blocks (A1–A4) are called base (B), the fifth block (A5) and the sixth block (A6) are called short arm (S) and the seventh block (A7) and the eighth block (A8) are called long arm (L).

Figure 2:
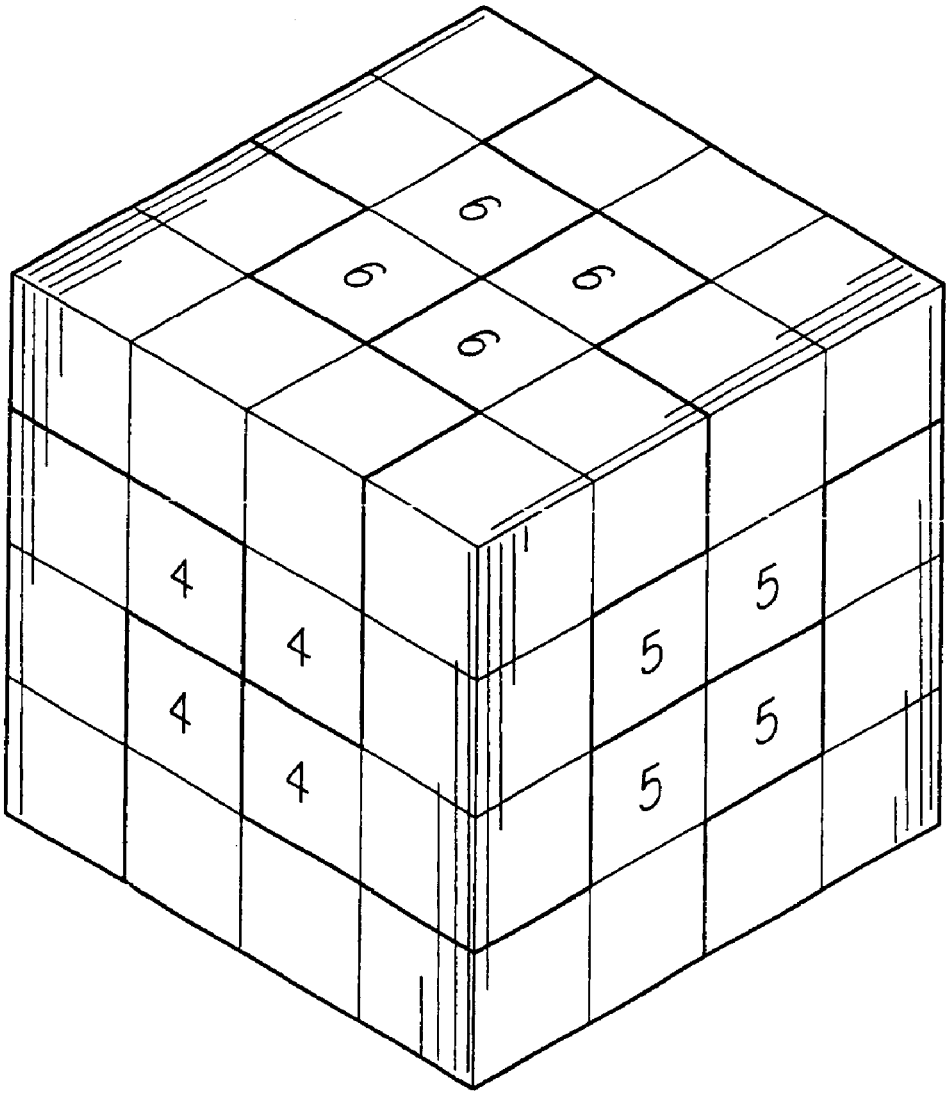
FIG. 2 is a perspective view of the cubic puzzle after assembly.

With reference to FIG. 2, it is noted that the cubic puzzle of the present invention is a 4×4×4 cube.

Figure 3:
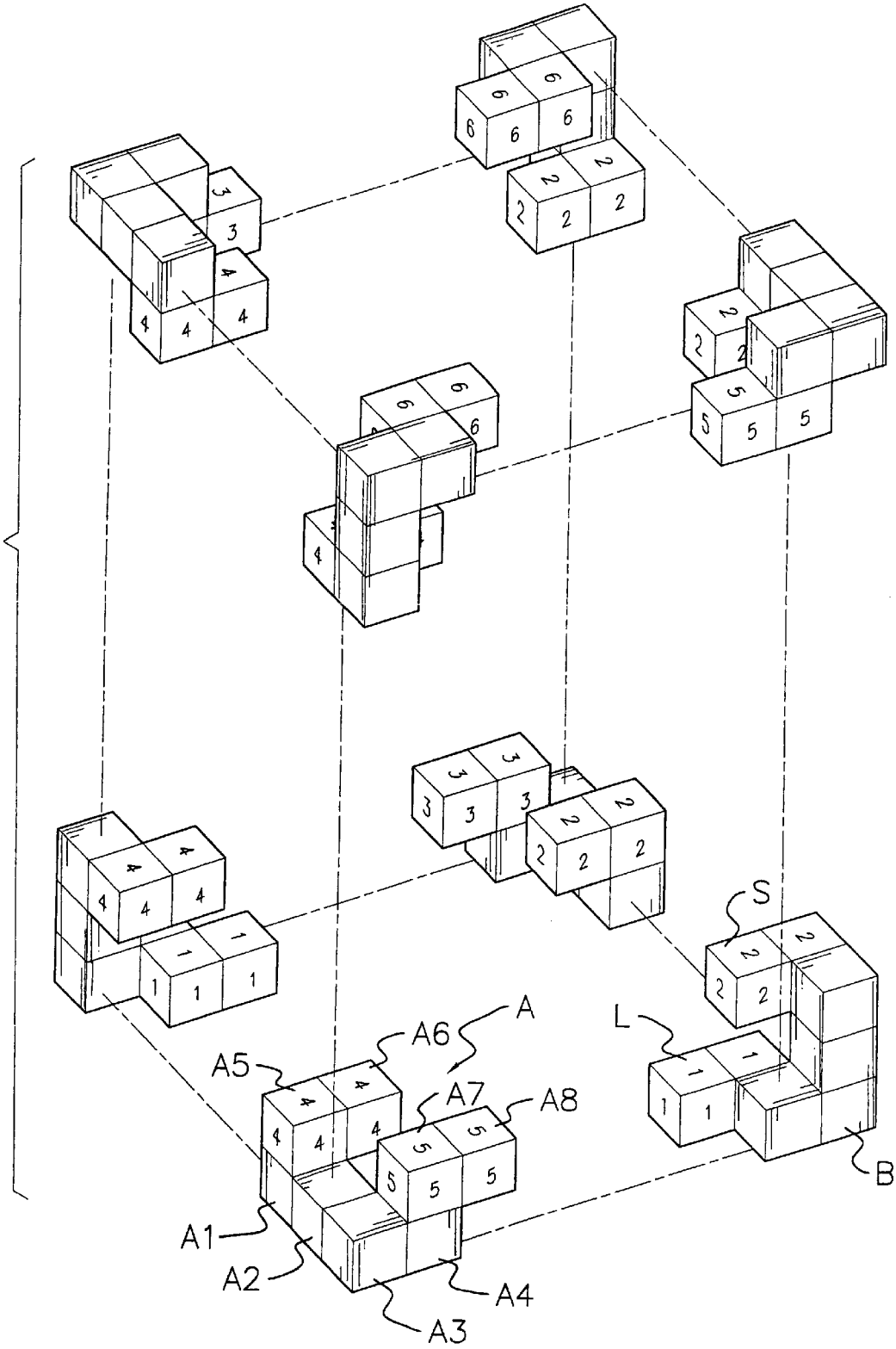
FIG. 3 is an exploded perspective view of the cubic puzzle of the present invention shown in FIG. 2.

With reference to FIG. 3, it is noted that the cubic puzzle of the present invention is composed of eight identical elementary pieces (A) each with a different orientation to the others. Each base (B) faces outward in respect to the assembly direction of the other elementary pieces (A) and is L-shaped. It is further noted that each corner of every base (B) is a corner of the cubic puzzle in assembly.

Figure 4:
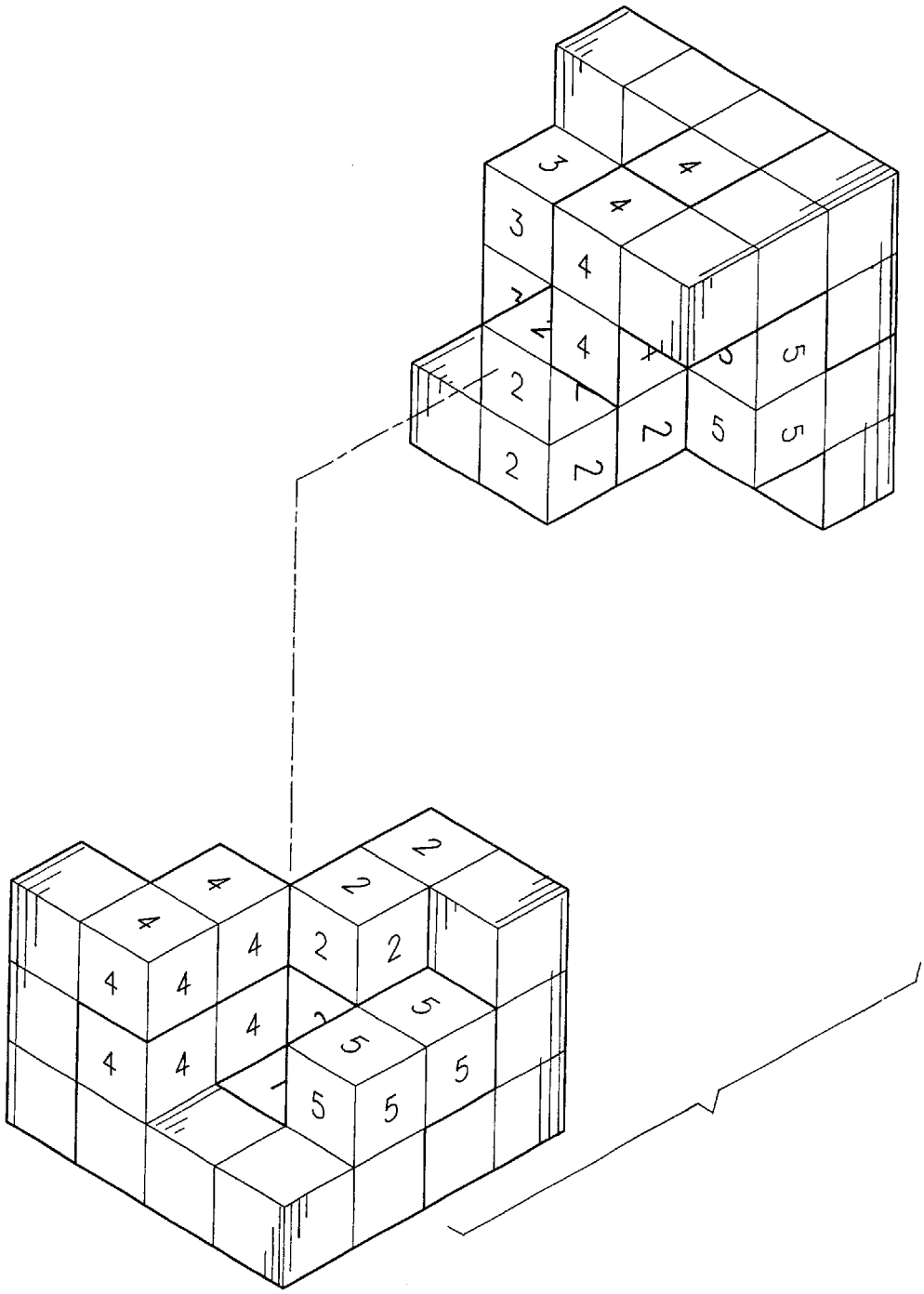
FIG. 4 is an exploded perspective view showing every two elementary pieces are assembled to form two identical halves to be assembled.
Figure 5:
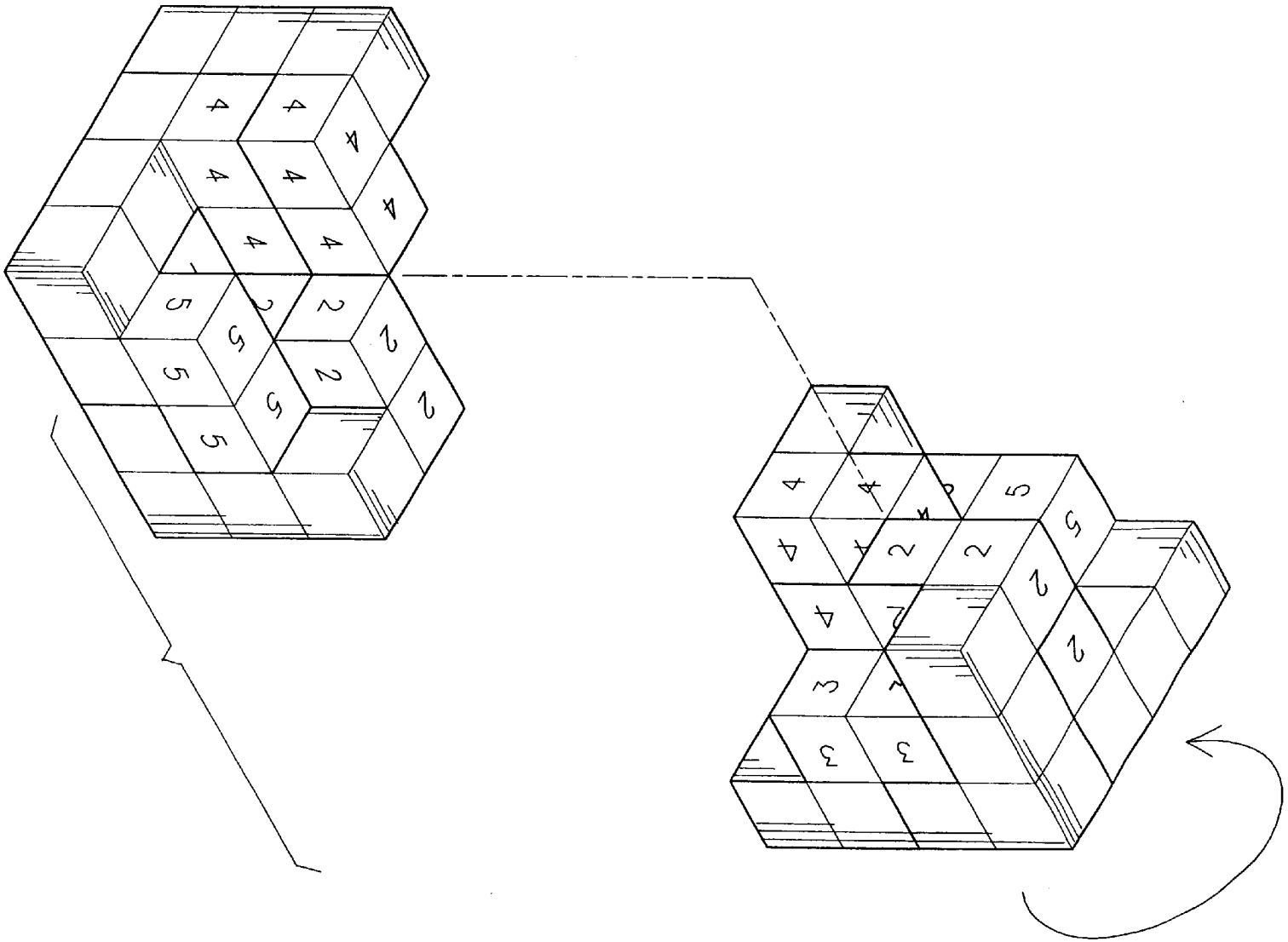
FIG. 5 is an exploded perspective view showing one of the two identical halves is rotated so as to assembled with the other half.

With reference to FIG. 4, when four elementary pieces (A) are assembled to form two identical halves (the upper half and the lower half), the user is able to rotate the upper half (or the lower half) 180°, as shown in FIG. 5, and then reassemble the upper half and the lower half together to construct the cubic puzzle, as shown in FIG. 2, again.

Figure 6:
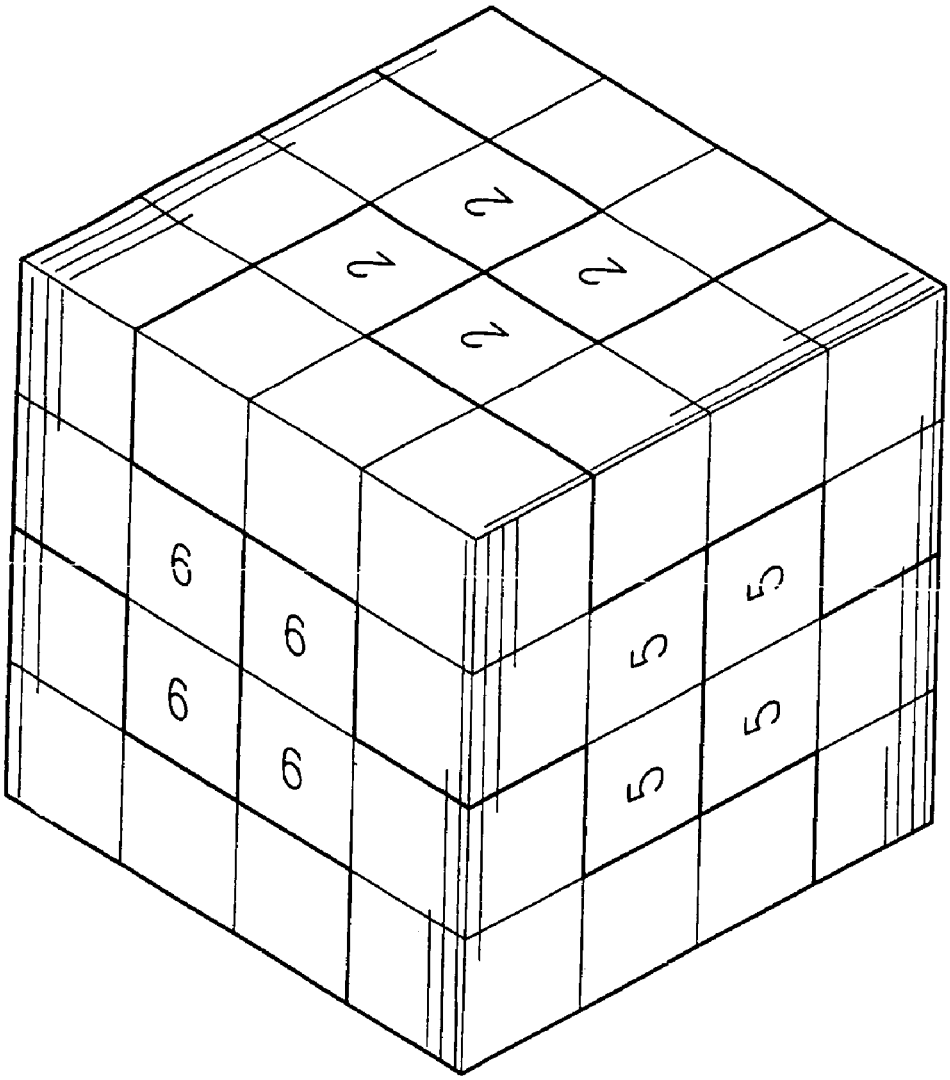
FIG. 6 is a perspective view of the cubic puzzle the same as that shown in FIG. 2, wherein the difference is that the cubic puzzle is rotated 90.
Figure 7:
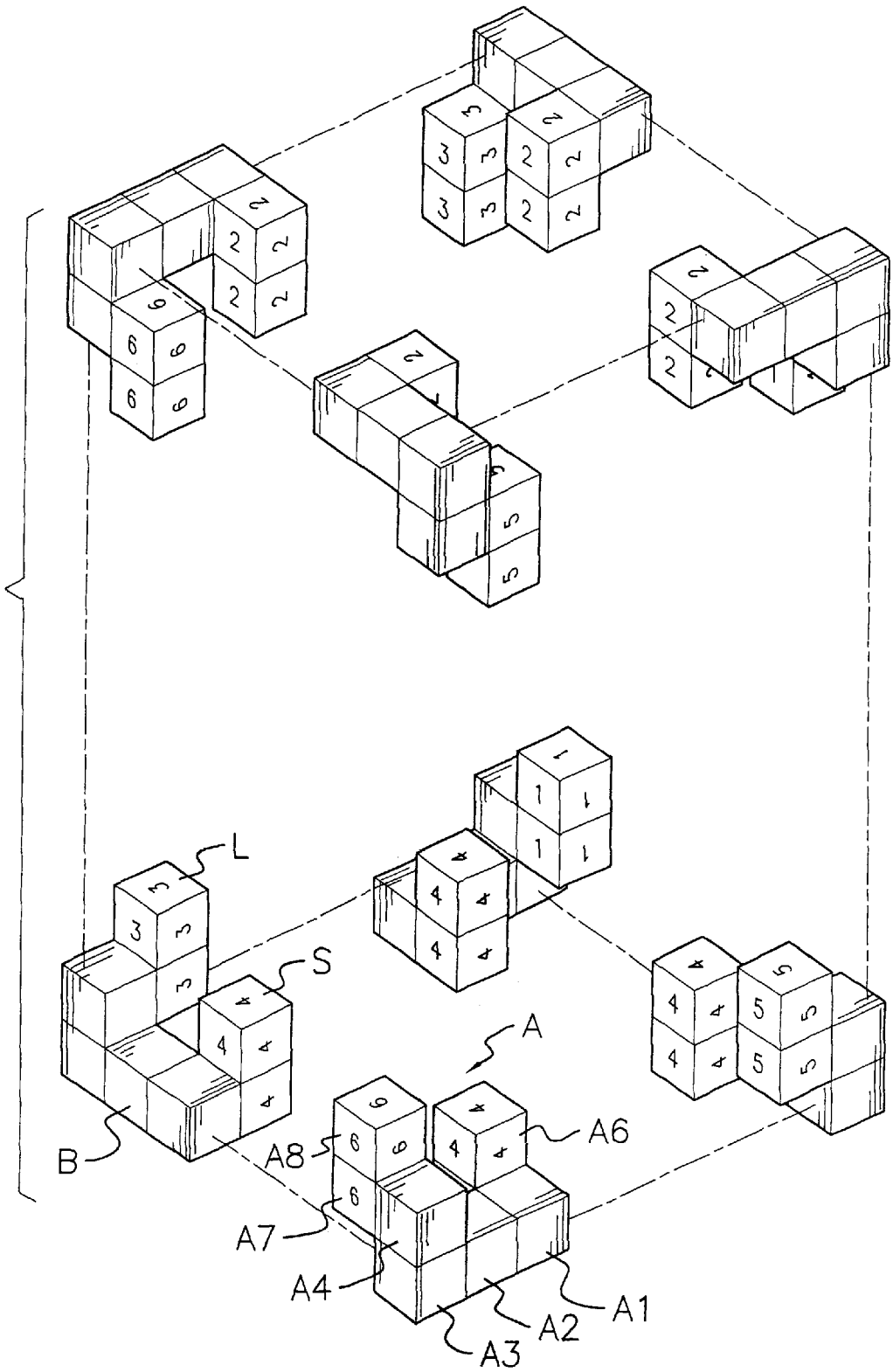
FIG. 7 is an exploded perspective view of the cubic puzzle shown in FIG. 6.

With reference to FIGS. 6 and 7 and taking FIG. 2 for reference, after rotating the cubic puzzle perpendicular to an x-axis of the cubic puzzle, the faces of the blocks designated with numeral 4 are rotated to a bottom of the faces of the blocks designated with numeral 6, the cubic puzzle of the present invention is able to be disassembled into eight identical elementary pieces (A) along a z-axis in FIG. 2, which are not in the same orientations as those shown in FIG. 3.

Figure 8:
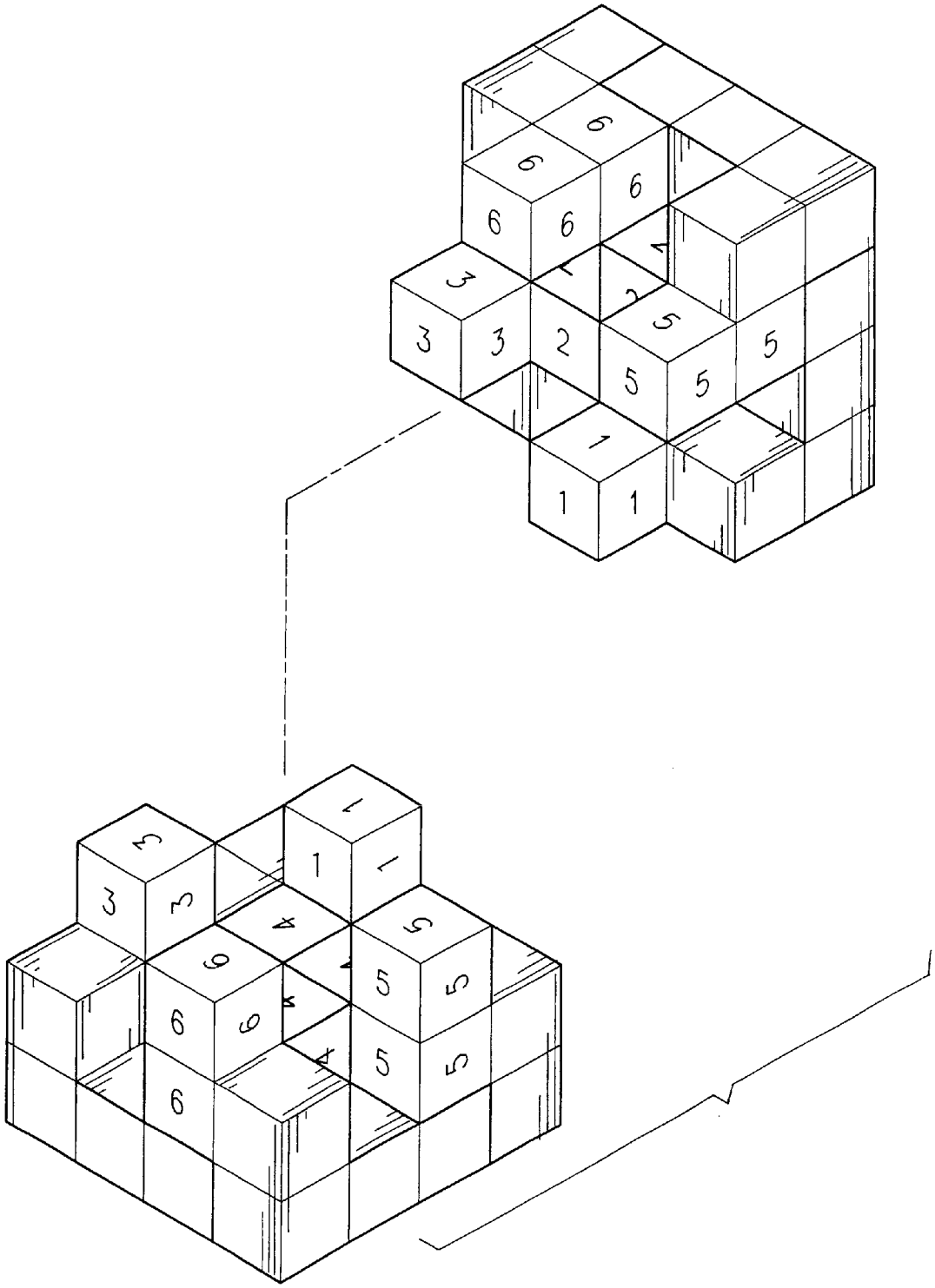
FIG. 8 is an exploded perspective view showing every two elementary pieces are assembled to form two *identical halves to be assembled, wherein each half is different from each half in FIG. 4.

With reference to FIG. 8, when the elementary pieces (A) in FIG. 7 are assembled, the short arms (S) of each of the elementary pieces (A) protrude out from a center of the upper half and the lower half respectively. The long arms (L) of each of the elementary pieces (A) from the upper half alternatively extend out relative to the long arms (L) of each of the elementary pieces (A) of the lower half. Therefore, when assembling the two halves, a cubic puzzle in FIG. 6 is presented.

Figure 9:
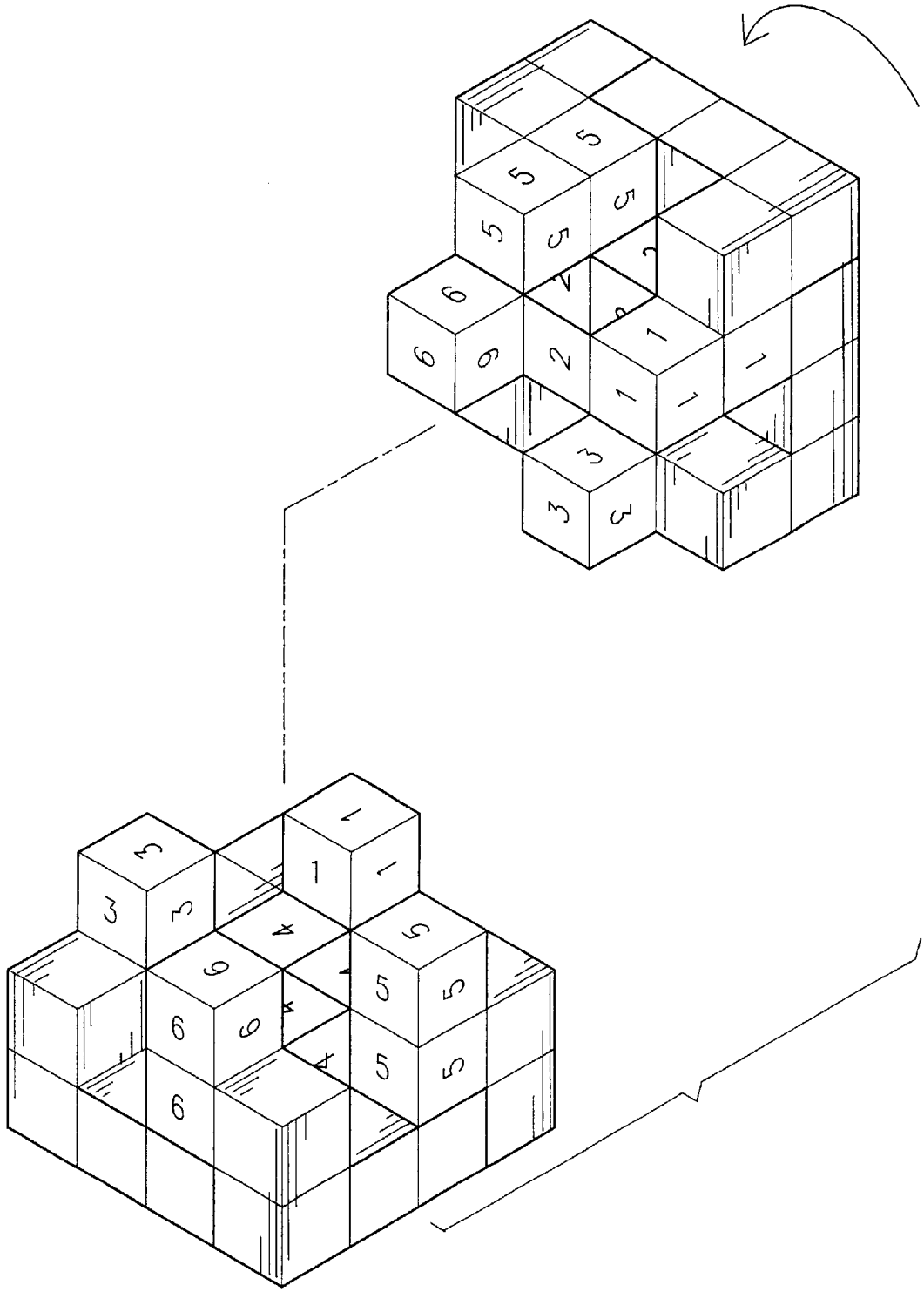
FIG. 9 is an exploded perspective view showing that one of the two identical halves is rotated 90° to be assembled with the other half to form the cubic puzzle of the present invention.

When rotating 90° the upper half in FIG. 8 to be in the orientation as shown in FIG. 9, the upper half can still be assembled with the lower half.

With reference to FIGS. 2 to 5, it is noted that when the cubic puzzle of the present invention is divided into the upper half and the lower half, the upper half (or the lower half) is able to be rotated 90° and then assembled with the lower half. However, when rotating the cubic puzzle again along a direction perpendicular to the x-axis of the cubic puzzle, the cubic puzzle is able to be disassembled into the upper half and the lower half, which are not the same as those shown in FIG. 5. Therefore, the user is able to use these two different regroupings of the elementary pieces (A) to reconstruct the cubic puzzle so that the faces with different numerals are able to be grouped together.

Referring to FIG. 2, it is noted that the cubic puzzle has numerals formed on central four faces of the blocks, wherein numerals 1, 2, 3, 4, 5 and 6 are respectively formed on the central four faces of the blocks of the cubic puzzle. Therefore, via continuous rotation in a direction perpendicular to the x-axis of the cubic puzzle, assembly and disassembly of the cubic puzzle, the numerals are rearranged and thus, the user is able to find entertainment via the process of regrouping the same numerals together.

Referring to FIGS. 3 and 7, it is noted that each face of the blocks of the long arm (L) is designated with a numeral and each face of the blocks of the short arm (S) is designated with a numeral different to the numeral of the blocks of the long arm (L). Within the embodiment of the present invention, four numerals (1,3,5,6) are formed on four pairs of the long arms (L) and two numerals (2,4) are respectively formed on every four short arms (S). Faces of the base (B) are not designated with any numerals. However, the numerals can be replaced by color or any pattern such as circular shape, star shape, triangular shape, square, etc.

During the process of grouping and regrouping the same numerals together, the user finds the cubic puzzle interesting and educational.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cubic puzzle comprising:

eight identical elementary pieces, wherein each elementary piece is composed of eight identical blocks, the eight blocks are distributed in an upper layer and a lower layer, wherein the lower layer has a first, a second, and a third block linearly connected to a side face of each other and a fourth block transversely and securely connected to a side of the third block, the upper layer has a fifth block securely connected to a side of a sixth block, wherein the fifth block is formed on top of the first block, a seventh block securely connected to a side of an eighth block, wherein the seventh block is formed on top of the fourth block, wherein a position relationship between the sixth block and the fifth block and the seventh block to the eighth block correspond to a position relationship between the fourth block and the third block, whereby rearrangement of the eight elementary pieces each with a unique orientation different from the others is able to form a cube.

2. The cubic puzzle as claimed in claim 1 having six faces, wherein each face is composed of 4×4 (sixteen) small faces of the blocks of the elementary pieces, four central small faces of each of the six faces of the cube are designated with numerals.

3. The cubic puzzle as claimed in claim 1 having six faces, wherein each face is composed of 4×4 (sixteen) small faces of the blocks of the elementary pieces, four central small faces of each of the six faces of the cube are designated with colors.

4. The cubic puzzle as claimed in claim 2, wherein the first to the fourth blocks are defined as a base, the fifth and the sixth blocks are defined as a short arm and the seventh and the eighth are defined as a long arm, the blocks of each of the long arms are designated with an identical numeral, the blocks of each of the short arms are designated with an identical numeral which is different to the numeral of the long arms, the blocks of the base are free of any numeral.

5. The cubic puzzle as claimed in claim 4, wherein four numerals are formed on four pairs of the long arms and two numerals are respectively formed on every four short arms.

6. The cubic puzzle as claimed in claim 3, wherein the first to the fourth blocks are defined as a base, the fifth and the sixth blocks are defined as a short arm and the seventh and the eighth are defined as a long arm, the blocks of each of the long arms are designated with an identical color, the blocks of each of the short arms are designated with an identical color which is different to the color of the long arm, the blocks of the base are free of any color.

7. The cubic puzzle as claimed in claim 6, wherein four colors are formed on four pairs of the long arms and two colors are respectively formed on every four short arms.

* * * * *